US011427950B2

(12) United States Patent
Capelotti et al.

(10) Patent No.: US 11,427,950 B2
(45) Date of Patent: Aug. 30, 2022

(54) METHOD OF DETERMINING VOLUME OF WATER TO ADD TO FIRST AND SECOND WASHING COMPARTMENTS OF A WASHING MACHINE AS A FUNCTION OF DETERMINED MOMENT OF INERTIA

(71) Applicant: WHIRLPOOL CORPORATION, Benton Harbor, MI (US)

(72) Inventors: Pedro H. Capelotti, Rio Claro (BR); Maurilio F. Catharino, St. Joseph, MI (US); Mauro R. Ushizima, Rio Claro (BR)

(73) Assignee: Whirlpool Corporation, Benton Harbor, MI (US)

( * ) Notice: Subject to any disclaimer, the term of this patent is extended or adjusted under 35 U.S.C. 154(b) by 319 days.

(21) Appl. No.: 16/547,650

(22) Filed: Aug. 22, 2019

(65) Prior Publication Data

US 2021/0054559 A1 Feb. 25, 2021

(51) Int. Cl.

| | |
|---|---|
| ***D06F 39/08*** | (2006.01) |
| ***D06F 23/04*** | (2006.01) |
| ***D06F 37/16*** | (2006.01) |
| ***D06F 37/30*** | (2020.01) |
| ***D06F 34/18*** | (2020.01) |
| *D06F 105/48* | (2020.01) |

(Continued)

(52) U.S. Cl.

CPC ..... *D06F 39/087* (2013.01); *D06F 23/04* (2013.01); *D06F 34/18* (2020.02); *D06F 37/16* (2013.01); *D06F 37/304* (2013.01); *D06F 39/088* (2013.01); *D06F 2103/04* (2020.02); *D06F 2105/02* (2020.02); *D06F 2105/48* (2020.02)

(58) Field of Classification Search

None

See application file for complete search history.

(56) References Cited

U.S. PATENT DOCUMENTS

| | | | |
|---|---|---|---|
| 3,481,162 | A | 12/1969 | Ziegler |
| 3,575,020 | A | 4/1971 | Hubbard |

(Continued)

FOREIGN PATENT DOCUMENTS

| | | | |
|---|---|---|---|
| KR | 900010000 | Y1 | 10/1990 |
| KR | 20010059865 | A | 7/2001 |

(Continued)

*Primary Examiner* — Cristi J Tate-Sims

(74) *Attorney, Agent, or Firm* — Price Heneveld LLP

(57) ABSTRACT

A washing machine includes a first washing compartment to hold a first set of articles to be washed and a second washing compartment to holds a second set of articles to be washed, the second washing compartment having an inserted position and a removed position. A liquid flow valve is configured to connect to an external liquid source to selectively control flow of liquid from the external liquid source and into one or more of the first washing compartment and the second washing compartment. An electric motor is configured to rotate the first washing compartment, and the second washing compartment, when the second washing compartment is in the inserted position. A controller, in communication with the electric motor, determines a mass of the second set of articles and then determines, as a function of the determined mass, a volume of water to be added to the second washing compartment.

20 Claims, 9 Drawing Sheets

(51) Int. Cl.
*D06F 105/02* (2020.01)
*D06F 103/04* (2020.01)

(56) References Cited

U.S. PATENT DOCUMENTS

| | | | | |
|---|---|---|---|---|
| 9,091,011 | B2 | 7/2015 | Janke et al. | |
| 9,540,756 | B2 | 1/2017 | Janke et al. | |
| 9,611,581 | B2 | 4/2017 | Seo et al. | |
| 9,863,078 | B2 | 1/2018 | Ramasco et al. | |
| 9,890,492 | B2 | 2/2018 | Cabral Melo et al. | |
| 2015/0047396 | A1 | 2/2015 | Beckert Polli et al. | |
| 2015/0184326 | A1* | 7/2015 | Seo | D06F 37/267 68/132 |
| 2015/0337474 | A1* | 11/2015 | Bodine | D06F 37/06 8/137 |
| 2016/0201243 | A1 | 7/2016 | Bergamo | |
| 2017/0089001 | A1* | 3/2017 | Obregon | D06F 33/34 |
| 2017/0167067 | A1* | 6/2017 | Lee | D06F 34/18 |
| 2017/0350061 | A1 | 12/2017 | Ramasco et al. | |
| 2018/0119327 | A1 | 5/2018 | Kim et al. | |

FOREIGN PATENT DOCUMENTS

| | | | |
|---|---|---|---|
| KR | 20150025734 | A | 3/2015 |
| KR | 20150030806 | A | 3/2015 |
| KR | 20170122613 | A | 11/2017 |
| KR | 20180057838 | A | 5/2018 |

* cited by examiner

METHOD OF DETERMINING VOLUME OF WATER TO ADD TO FIRST AND SECOND WASHING COMPARTMENTS OF A WASHING MACHINE AS A FUNCTION OF DETERMINED MOMENT OF INERTIA

BACKGROUND OF THE DISCLOSURE

Clothes washing machines wash clothing, fabric, and other items (hereinafter collectively referred to as "articles"). Some washing machines utilize a tub with a solitary washing compartment, which can be perforated, disposed inside the tub. The solitary washing compartment holds the articles to be washed, and the tub holds a liquid such as water to assist in the washing operation. Some washing machines incorporate a first washing compartment, like the solitary washing compartment, as well as a second, removable, washing compartment. The second washing compartment allows for washing of a second set of articles simultaneously with the washing of a first set of articles in the first washing compartment.

However, there is a problem in that the washing machines that utilize the second, removable, washing compartment do not automatically determine an optimal amount of water to utilize in the second washing compartment. This failure can result in the additional problem of the washing machine adding a volume of liquid to the second washing compartment that overflows, along with any laundering chemicals in the second washing compartment, from the second washing compartment into the first washing compartment. That overflowing potentially transfers undesirable substances, such as bleach, dye, and cleaning agents, from the first washing compartment to the second washing compartment.

SUMMARY OF THE DISCLOSURE

The present disclosure solves those problems with a washing machine that estimates or calculates the mass of the set of articles in the second, removable, washing compartment, then determines a volume of water (insufficient to overflow into the first washing compartment) to add to the second washing compartment as a function of the estimated or calculated mass, and then adds that determined volume of water to the second washing compartment.

According to one aspect of the present disclosure, a washing machine includes a tub. A first washing compartment is disposed within the tub to hold a first set of articles to be washed, the first set of articles having a mass. A second washing compartment holds a second set of articles to be washed, the second set of articles having a mass, the second washing compartment having an inserted position and a removed position. A liquid flow valve is configured to connect to an external liquid source to selectively control flow of liquid from the external liquid source and into either the first washing compartment, the second washing compartment, or both the first washing compartment and the second washing compartment. An electric motor is operably coupled to and configured to cause the first washing compartment to rotate, and operably coupled to and configured to cause the second washing compartment to rotate when the second washing compartment is in the inserted position but not in the removed position. A controller is in communication with the electric motor that estimates or calculates the mass of the second set of articles held by the second washing compartment and then calculates, as a function of the estimated or calculated mass of the second set of articles, a volume of water to be added to the second washing compartment.

According to another aspect of the present disclosure, a washing machine includes a tub. A first washing compartment is disposed within the tub to hold a first set of articles to be washed, the first set of articles having a mass. A second washing compartment holds a second set of articles to be washed, the second set of articles having a mass, the second washing compartment having an inserted position and a removed position. A liquid flow valve is configured to connect to an external liquid source to selectively control flow of liquid from the external liquid source and into either the first washing compartment, the second washing compartment, or both the first washing compartment and the second washing compartment. An electric motor is operably coupled to and configured to cause the first washing compartment to rotate, and operably coupled to and configured to cause both the first washing compartment and the second washing compartment to rotate when the second washing compartment is in the inserted position but not in the removed position. A controller is in communication with the electric motor and is configured to: (a) to cause the electric motor to rotate together the first washing compartment and the second washing compartment at a predetermined rotational speed when the second washing compartment is in the inserted position and contains the second set of articles; (b) to cause liquid to flow from the external liquid source and into the second washing compartment while the second washing compartment is rotating at the predetermined rotational speed; (c) to cause the electric motor to maintain rotating the first washing compartment and the second washing compartment at the predetermined rotational speed, while monitoring the moment of inertia of the second washing compartment together with the second set of articles and the liquid in the second washing compartment; and (d) as the moment of inertia meets or exceeds a predetermined value, or as the moment of inertia meets or exceeds a predetermined rate of change, to cause the electric motor to stop rotating the first washing compartment and the second washing compartment and to stop liquid from flowing from a liquid supply system into the second washing compartment.

According to yet another aspect of the present disclosure, a method of adding a volume of water to a removable washing compartment of a washing machine includes, after a first set of articles is loaded into a first washing compartment of a washing machine and while a second washing compartment of the washing machine is in a removed position, estimating or calculating a mass of the first set of articles in the first washing compartment; after the second washing compartment is placed into an inserted position and a second set of articles is loaded into the second washing compartment, estimating or calculating a mass of the second set of articles in the second washing compartment; adding a second volume of water to the second washing compartment, without causing water added to the second washing compartment to overflow from the second washing compartment into the first washing compartment, the second volume of water determined as a function of the estimated or calculated mass of the second set of articles; and adding a first volume of water to the first washing compartment, the first volume of water determined as a function of the estimated or calculated mass of the first set of articles.

These and other features, advantages, and objects of the present disclosure will be further understood and appreciated by those skilled in the art by reference to the following specification, claims, and appended drawings.

Figure 1:
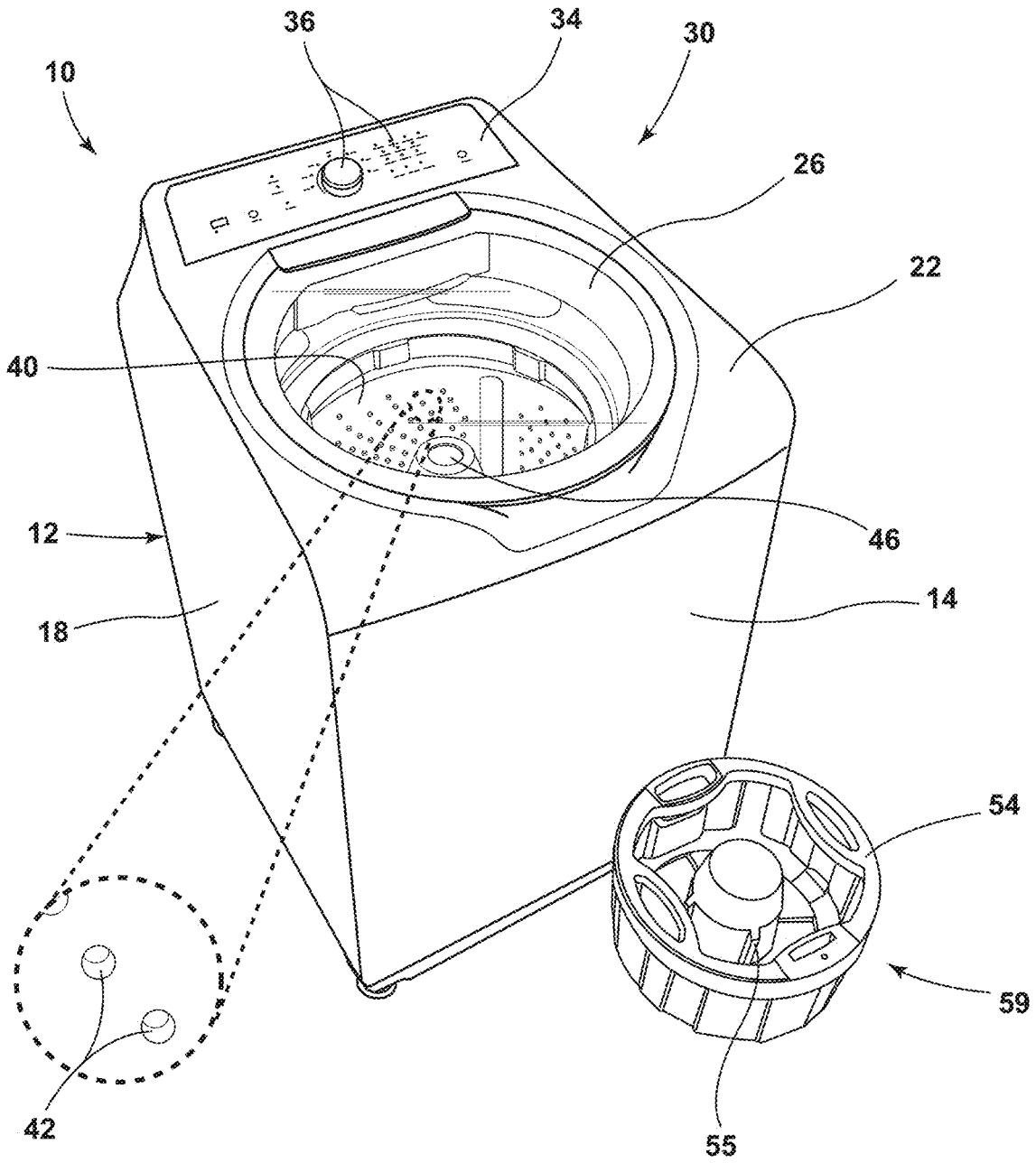
FIG. 1 is a perspective view of a washing machine of the present disclosure, illustrating a first washing compartment and a second washing compartment in a removed position.
Figure 2:
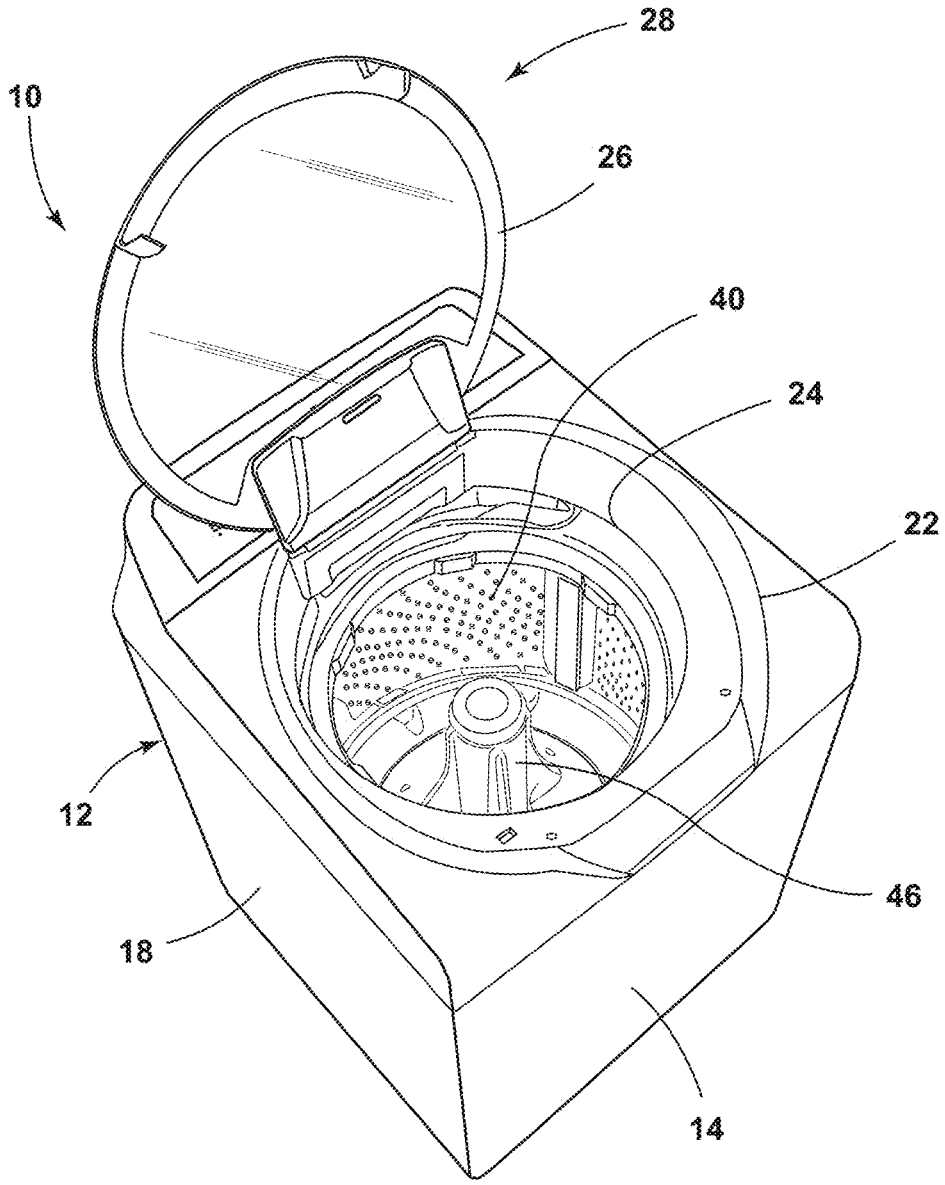
FIG. 2 is a perspective view of the washing machine of FIG. 1, illustrating a lid of the washing machine in an opened position providing access through an opening into the first washing compartment.
Figure 3:
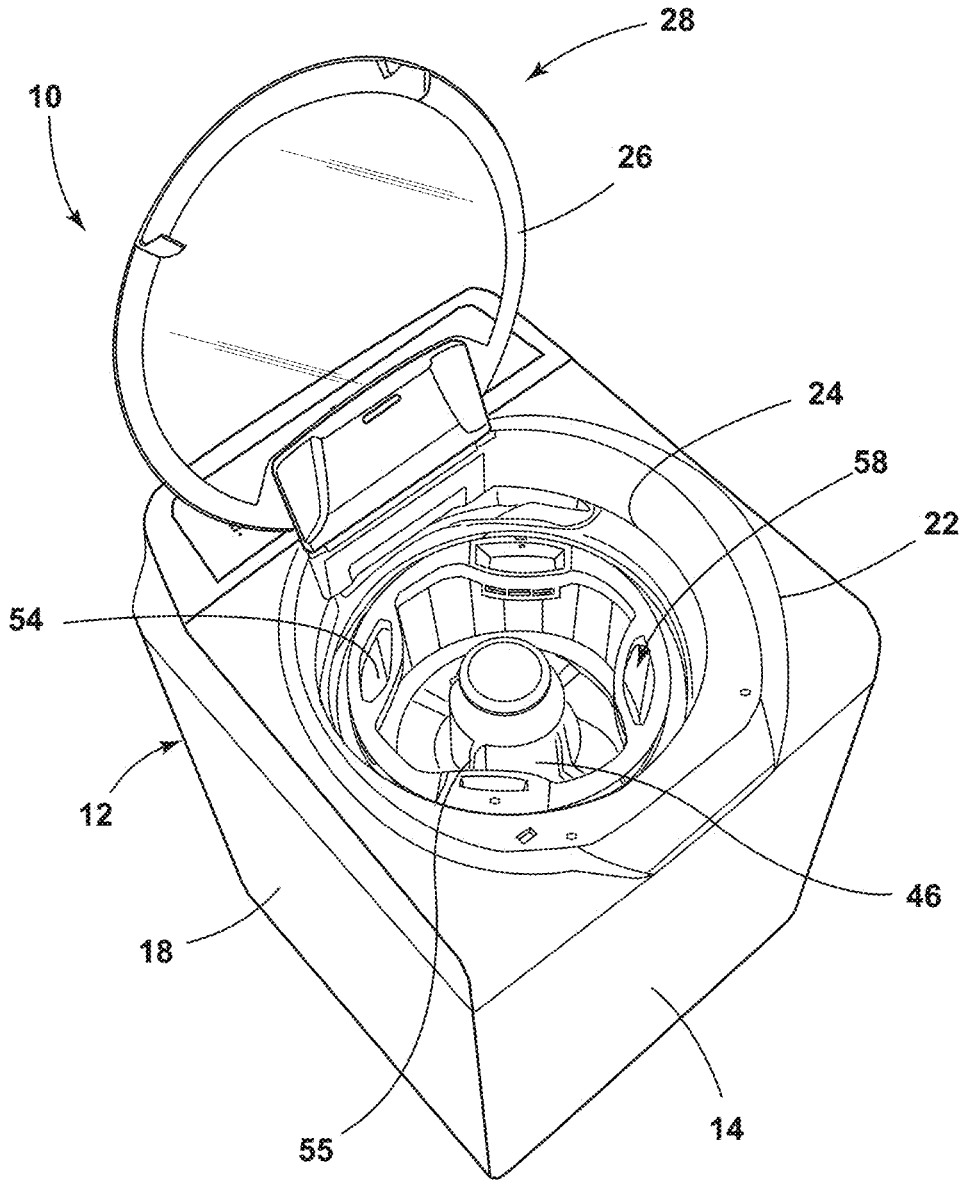
FIG. 3 is a perspective view of the washing machine of FIG. 1, illustrating the lid in the washing machine in the opened position and the second washing compartment in the inserted position above and partially surrounded by the first washing compartment.
Figure 4:
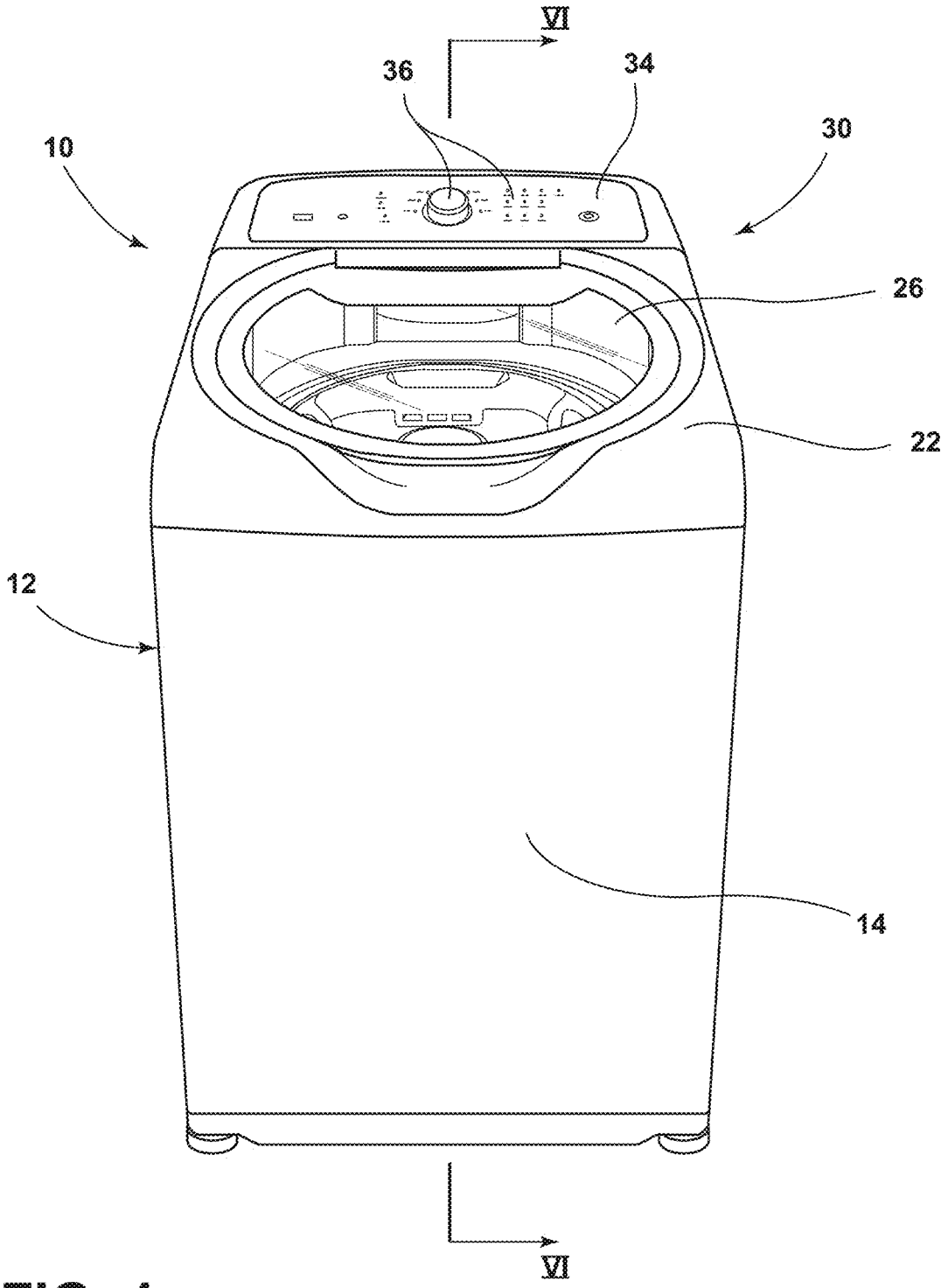
FIG. 4 is a front perspective view of the washing machine of FIG. 1, illustrating the lid in a closed position and the second washing compartment in the inserted position below the lid.
Figure 5:
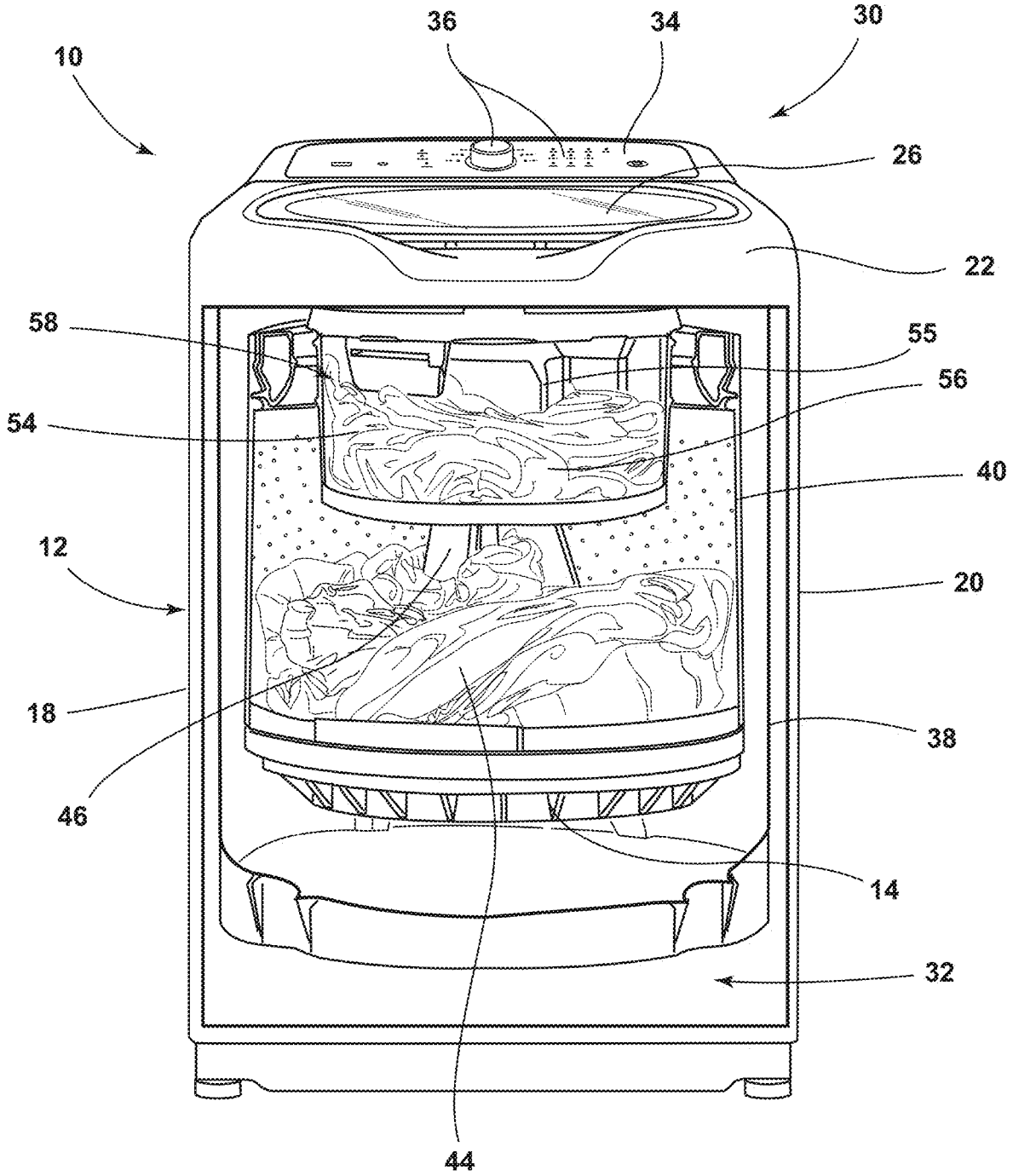
FIG. 5 is a front perspective view of the washing machine of FIG. 1, illustrating an interior of the washing machine as if a front wall portion of a cabinet of the washing machine were absent, the first washing compartment holding a first set of articles, and the second washing compartment holding a second set of articles, allowing both the first set of articles and the second set of articles to be simultaneously washed.
Figure 6:
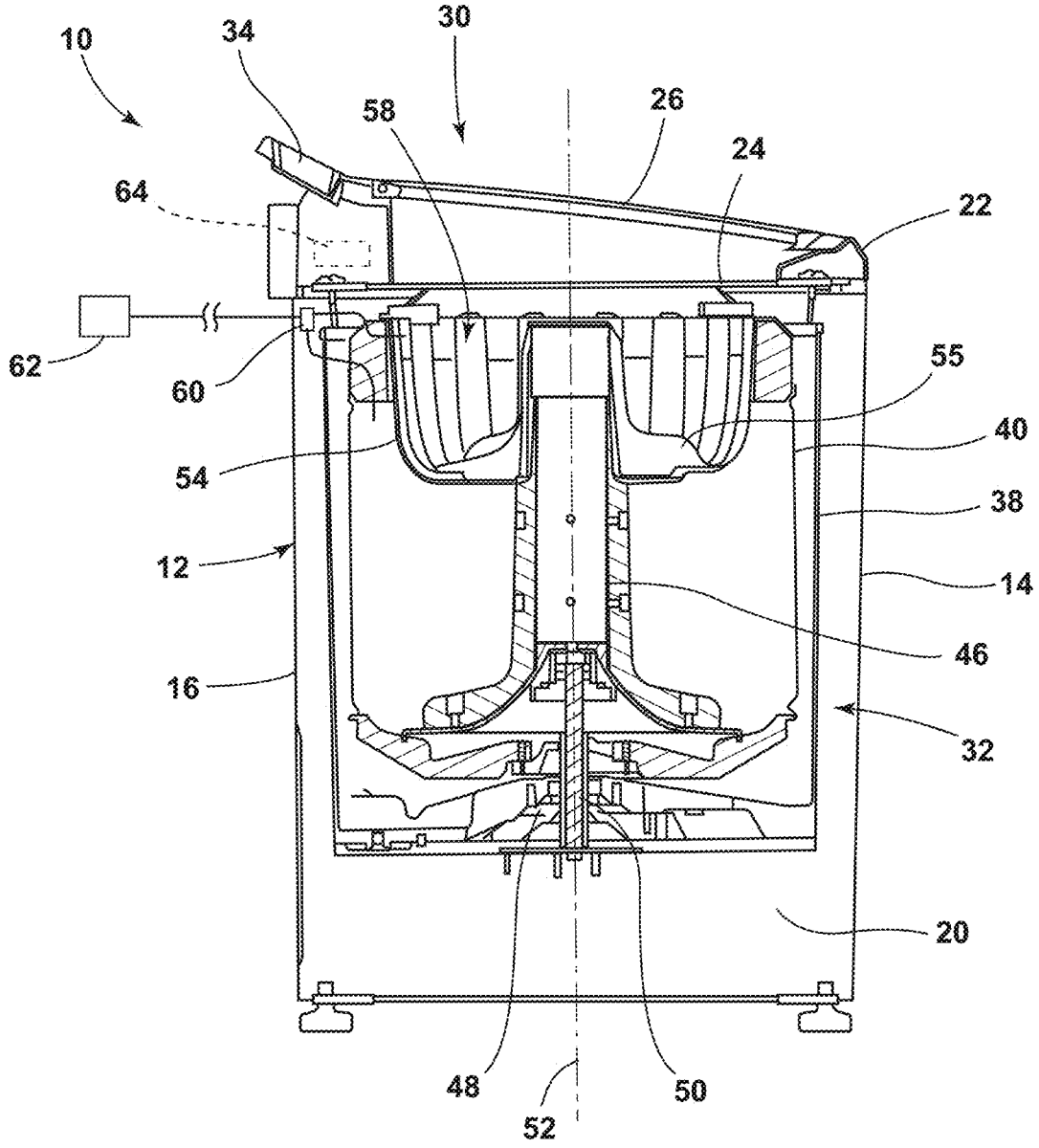
FIG. 6 is a cross-sectional view of the washing machine of FIG. 1 taken through line VI-VI of FIG. 4, illustrating a motor operably coupled to a shaft, which is operably coupled to the first washing compartment, an agitator, and the second washing compartment (while in the inserted position) through the agitator.
Figure 7:
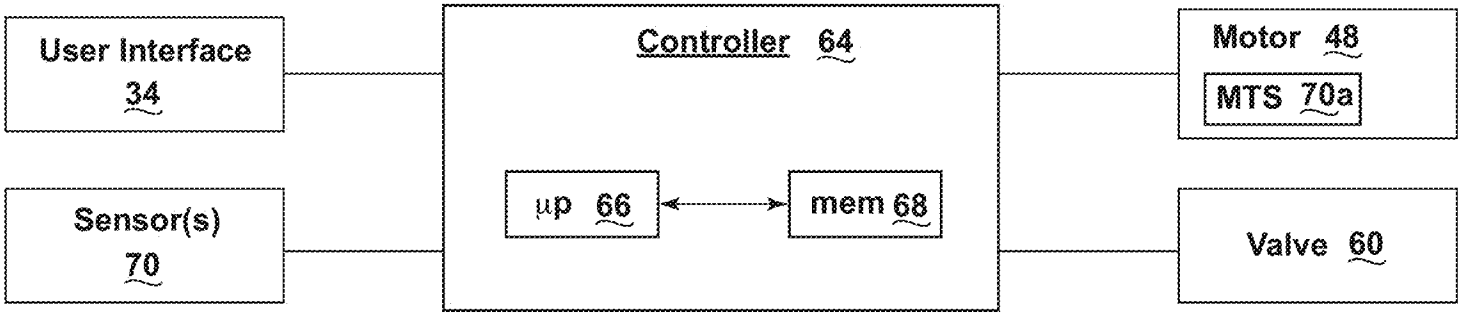
FIG. 7 is a schematic diagram for a controller of the washing machine of FIG. 1, illustrating the controller controlling the motor and a liquid (water) control valve to supply liquid selectively to the first washing compartment and the second washing compartment.

The components in the figures are not necessarily to scale, emphasis instead being placed upon illustrating the principles described herein.

DETAILED DESCRIPTION

The present illustrated embodiments reside primarily in combinations of method steps and apparatus components related to a washing machine. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "rear," "front," "side," "top," "beneath," and derivatives thereof shall relate to the disclosure as oriented in FIG. 1. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-6, a washing machine 10 of the present disclosure is illustrated. The washing machine 10 illustrated is of the top loading variety, but could be of the front loading variety as well. The washing machine 10 includes a cabinet 12. The cabinet 12 includes a front wall portion 14, a rear wall portion 16, and side wall portions 18, 20 that extend from the front wall portion 14 to the rear wall portion 16. The cabinet 12 further includes a top portion 22 with an opening 24 and a lid 26 disposed at the top portion 22 that can move to, from, and between an opened position 28 and a closed position 30 to selectively allow or deny access to the opening 24. The front wall portion 14, the rear wall portion 16, and the side wall portions 18, 20 can each be formed as separate pieces, or may be formed as one or more continuous pieces. For example, the rear wall portion 16 can be separate, while the front wall portion 14 and the side wall portions 18, 20 can be continuous with each other. The front wall portion 14, the rear wall portion 16, and the side wall portions 18, 20 can be mounted to a frame (not shown). The cabinet 12 defines an interior 32 enclosing components typically found in a conventional washing machine 10, such as motors, pumps, fluid lines, controls, sensors, transducers, and the like. A user interface 34 can include multiple controls 36 (such as knobs and switches) and displays, and for communicating with the user, such as to receive input and provide output.

The washing machine 10 further includes a tub 38 and a first washing compartment 40 disposed within the tub 38. In the illustrated embodiment, the first washing compartment 40 is perforated with perforations 42 while the tub 38 is not. The first washing compartment 40 can hold a first set of articles 44 to be washed. The first set of articles 44 has a mass, which will vary from load-to-load as a function of the composition of the first set of articles 44.

A first agitator 46 is located in the first washing compartment 40. During operation of the washing machine 10, the first agitator 46 imparts mechanical agitation to the first set of articles 44 placed in the first washing compartment 40 and extends upwardly from the bottom of the first washing compartment 40. The first washing compartment 40 and the first agitator 46 are driven by an electric motor 48 via a shaft 50. Stated another way, the electric motor 48 is operably coupled to and configured to cause the first washing compartment 40 and the first agitator 46 to move. More specifically, the electric motor 48 includes the shaft 50, and the shaft 50 rotates about an axis 52. The electric motor 48 can cause the first agitator 46 to move independently of the first washing compartment 40, such that the first agitator 46 can mechanically agitate as mentioned above while the first washing compartment 40 remains stationary. In addition, the electric motor 48 can cause the first washing compartment 40 and the first agitator 46 to rotate simultaneously about the axis 52 as the electric motor 48 causes the shaft 50 to rotate about the axis 52, such as during a spin cycle as known in the art. The electric motor 48 can be a three-phase induction motor, a brushless permanent magnet (BPM), or a single-phase induction motor (i.e., a permanent split capacitor with motor sensing capabilities).

The washing machine 10 further includes a second washing compartment 54. The second washing compartment 54 can hold a second set of articles 56 to be washed. The second set of articles 56 has a mass, which again varies from load-to-load depending on the composition of the second set of articles 56. The second washing compartment 54 releasably couples to the first washing compartment 40, such that when the electric motor 48 drives the first washing compartment 40, the electric motor 48 drives the second washing compartment 54 as well. A second agitator 55 releasably couples to the first agitator 46, such that when the electric motor 48 drives the first agitator 46, the electric motor 48 drives the second agitator 55 as well. The second washing compartment 54 is removable in that the second washing compartment 54 is movable to, from, and between an inserted position 58 where the second washing compartment 54 is coupled to the first washing compartment 40 and a removed position 59 where the second washing compartment 54 is not coupled to the first washing compartment 40 and not beneath the lid 26 when the lid 26 is in the closed position 30. The first washing compartment 40 can be utilized to wash the first set of articles 44 independently while the second washing compartment 54 is in the removed position 59. When the second washing compartment 54 is in the inserted position 58, the electric motor 48 can actuate the second washing compartment 54 through the first washing compartment 40 and cause the second washing compartment 54 to rotate about the axis 52. Thus, when the second washing compartment 54 is in the inserted position 58, as the electric motor 48 causes the shaft 50 to rotate about the axis 52, both the first washing compartment 40 and the second washing compartment 54 can also rotate simultaneously about the axis 52. When the second washing compartment 54 is in the inserted position 58, the electric motor 48 can actuate the second agitator 55 through the first agitator 46 and cause the second agitator 55 to rotate about the axis 52. Thus, when the second washing compartment 54 is in the inserted position 58, as the electric motor 48 causes the shaft 50 to rotate about the axis 52, both the first agitator 46 and the second agitator 55 can rotate simultaneously about the axis 52. However, when the second washing compartment 54 is in the removed position 59, the electric motor 48 cannot cause either the second washing compartment 54 or the second agitator 55 to rotate.

The washing machine 10 further includes a liquid flow valve 60. The liquid flow valve 60 controls the inlet of liquid (such as water) into the washing machine 10 from an external liquid source 62. The liquid flow valve 60 can be connected to the external liquid source 62 through tubing as known in the art. The liquid flow valve 60 selectively controls the flow of liquid from the external liquid source 62 into either the first washing compartment 40, the second washing compartment 54, or both the first washing compartment 40 and the second washing compartment 54. For example, when the second washing compartment 54 is in the removed position 59 and only the first washing compartment 40 is being utilized to wash the first set of articles 44, then the liquid flow valve 60 can control the flow of liquid from the external liquid source 62 to flow into the first washing compartment 40. When the second washing compartment 54 is in the inserted position 58 to wash the second set of articles 56, in addition to the first set of articles 44 in the first washing compartment 40, the liquid flow valve 60 can cause liquid to flow from the external liquid source 62 into only the second washing compartment 54 at a certain point in time, only into the first washing compartment 40 at a different point in time, or into both the first washing compartment 40 and the second washing compartment 54 simultaneously.

The washing machine 10 further includes a controller 64. The controller 64 can include a microprocessor 66 and a memory 68. The microprocessor 66 can execute programs stored in the memory 68 to effectuate the method herein described below. The memory 68 can also be used to store information, such as a database, table, or calculated data pertinent to the method below, and to store data received from one or more components of the washing machine 10 that may be communicably coupled with the controller 64. The controller 64 is in communication with, and controls the operation of, the electric motor 48, the liquid flow valve 60, and the washing machine 10 generally. The controller 64 can receive input from, and provide output to, the user of the washing machine 10 via the user interface 34. The controller 64 performs further functions as described below. The controller 64 may also be coupled with one or more sensors 70 provided in one or more of the systems of the washing machine 10 to receive input from the sensors 70, an example of which includes a torque measurement from the motor controller or a motor torque sensor 70*a*.

The motor torque sensor 70*a* can be a measurement device that is part of the electric motor 48 separate from the controller 64 or can be part of the controller 64, separate from the electric motor 48, that collects measurements from the electric motor 48 and computes torque. Contemporary electric motors 48 often incorporate a dedicated controller that can output data relative to the electric motor 48 to the controller 64, such as rotational speed, current utilized, voltage applied, direction of rotation, and torque imparted, etc. If the dedicated controller does not specifically output data concerning torque imparted, but outputs other types of data related to current utilized and voltage applied, which are indicative of torque imparted, then the controller 64 may use that data to determine the torque applied by the electric motor 48 using a program that may be stored in the memory 68 of the controller 64.

Figure 8:
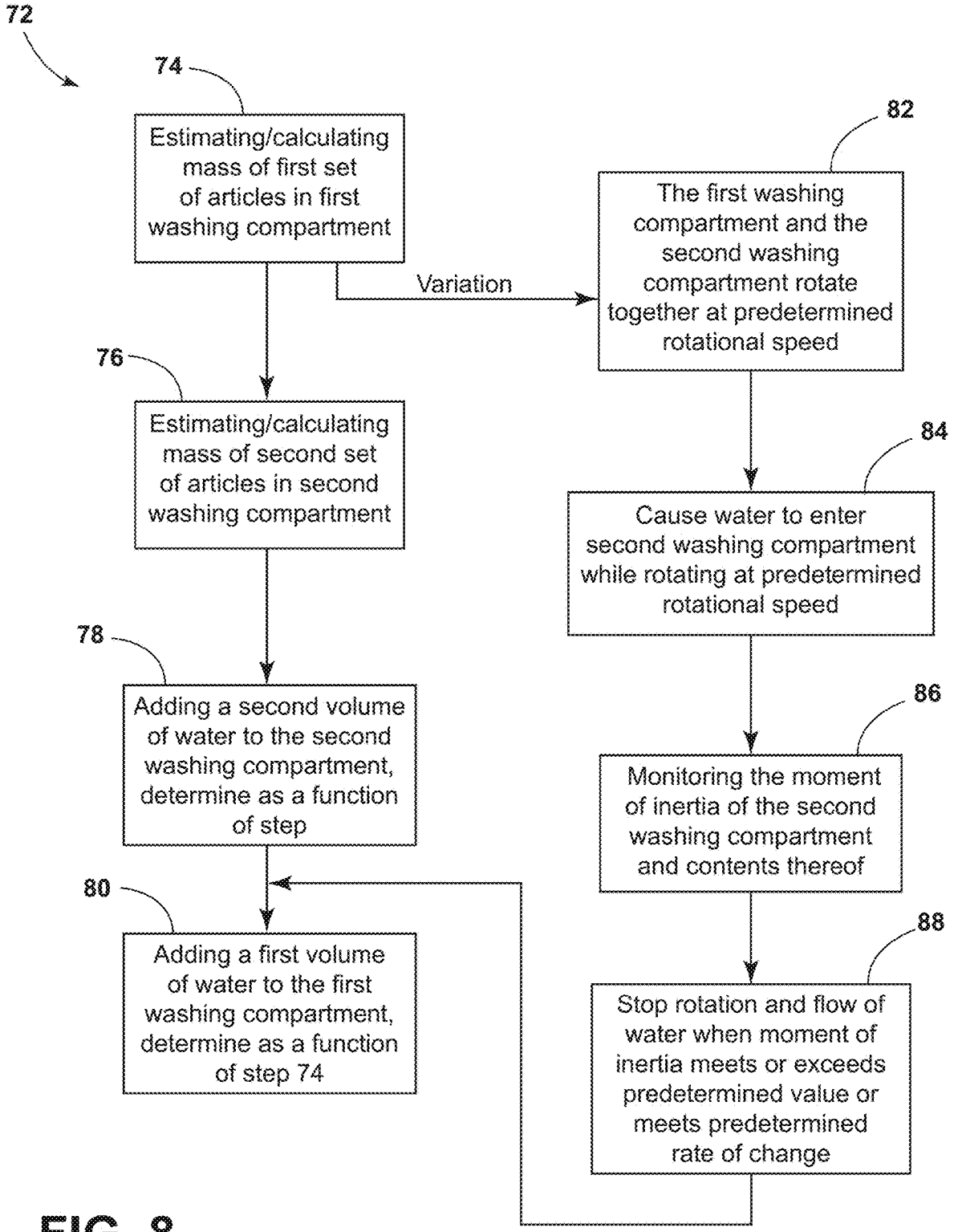
FIG. 8 is a flow diagram for a method of adding a volume of liquid (water) to the second, removable, washing compartment of the washing machine of FIG. 1, which is determined as a function of the mass of the second set of articles, which is determined by the controller via estimation/calculation of the moment of inertia of the second washing compartment with the second set of articles.

Referring now to FIG. 8, a method 72 of adding a volume of water to the second washing compartment 54 (a removable washing compartment) of the washing machine 10 includes a step 74 of estimating or calculating the mass of the first set of articles 44 in the first washing compartment 40. Before step 74, the user will have loaded the first set of articles 44 into the first washing compartment 40, while the second washing compartment 54 is in the removed position 59. In embodiments, the controller 64 estimates or calculates the mass of the first set of articles 44 when the second washing compartment 54 is in the removed position 59 by estimating or calculating the moment of inertia of the first set of articles 44.

Figure 9:
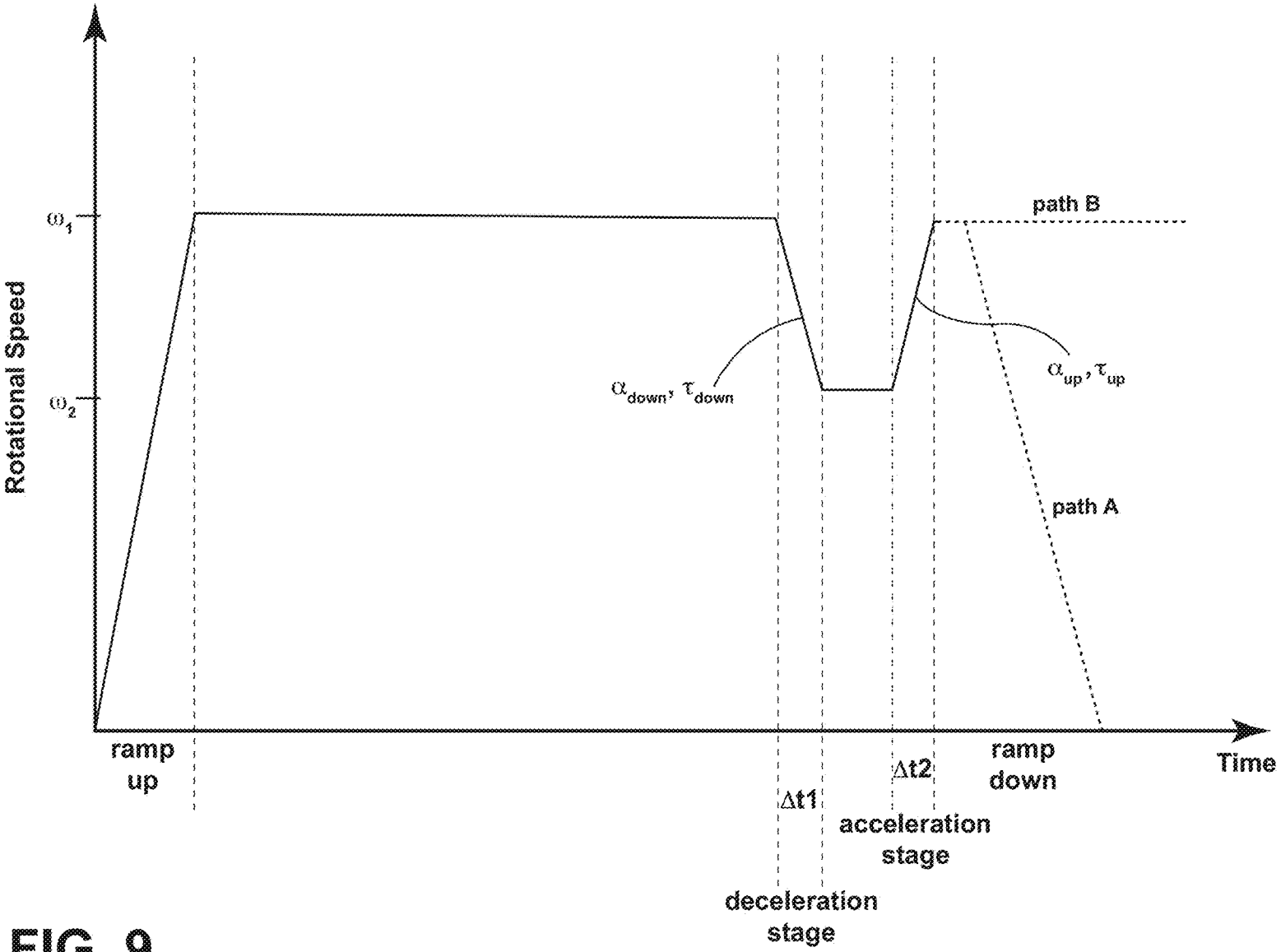
FIG. 9 is a graph of rotational speed of either the first washing compartment, or both the first washing compartment and the second washing compartment, as a function of time, illustrating a deceleration stage and an acceleration stage, from which the torque imparted by the electric motor can be determined in order to determine subsequently the mass of the first set of articles or the second set of articles, as the case may be.

In embodiments, the controller 64 estimates or calculates the moment of inertia of the first set of articles 44 (and, from the moment of inertia, the mass of the first set of articles 44), at least in part by causing the first washing compartment 40 with the first set of articles 44 to rotate according to a rotational speed as a function of time profile as set forth in FIG. 9. First, the controller 64 causes the electric motor 48 to rotate the first washing compartment 40 at a first substantially constant rotational speed ($\omega_1$), after a ramp up period where the first washing compartment 40 is accelerated from a rest state to the first substantially constant rotational speed ($\omega_1$). Second, during a deceleration stage, the controller 64 controls the electric motor 48 to cause the rotational speed of the first washing compartment 40 (containing the first set of articles 44) to decrease from the first substantially constant rotational speed ($\omega_1$) to a second substantially constant rotational speed ($\omega_2$) over a first period of time ($\Delta_{t1}$) for an average deceleration ($\alpha_{down}$) of $$\frac{(\omega_1 - \omega_2)}{\Delta_{t1}}.$$

Third, during an acceleration phase, the controller 64 controls the electric motor 48 to cause the rotational speed of the first washing compartment 40 (containing the first set of articles 44) to increase from the second substantially constant rotational speed ($\omega_2$) to the first substantially constant rotational speed ($\omega_1$) over a second period of time ($\Delta_{t2}$) for an average acceleration ($\alpha_{up}$) of $$\frac{(\omega_2 - \omega_1)}{\Delta_{t2}}.$$

The controller 64 then controls the electric motor 48 to decelerate the rotation of the first washing compartment 40 back to rest during a ramp down period (see path A, FIG. 9). The controller 64 maintains the first substantially constant rotational speed ($\omega_1$) and the second substantially constant rotational speed ($\omega_2$) at least long enough for the electric motor 48 to stabilize. The first washing compartment 40 with the first set of articles 44 is accelerated and decelerated in this manner while the first set of articles 44 are in their original "dry" state, that is, the washing machine 10 has not added a volume of water to the first washing compartment 40 yet. The first substantially constant rotational speed ($\omega_1$) and the second substantially constant rotational speed ($\omega_2$) can be any suitable speed and may be tuned to provide the best signal-to-noise ratio for data sensing, which depends on the particular configuration of the washing machine 10. The average acceleration/deceleration ($\alpha_{up}$ and $\alpha_{down}$) can be any suitable acceleration or deceleration, and can have the same or different absolute values. In embodiments, the average acceleration/deceleration ($\alpha_{up}$ and $\alpha_{down}$) have the same absolute value.

In embodiments, the controller 64 estimates or calculates the moment of inertia of the first set of articles 44 (and, from the moment of inertia, the mass of the first set of articles 44), at least in part by sensing, estimating, or calculating the torque ($\tau_{down}$) that the electric motor 48 outputs while causing the rotational speed of the first washing compartment 40 with the first set of articles 44 to decrease from the first substantially constant rotational speed ($\omega_1$) to the second substantially constant rotational speed ($\omega_2$) over the first period of time ($\Delta_{t1}$). Similarly, In embodiments, the controller 64 estimates or calculates the moment of inertia of the first set of articles 44 (and, from the moment of inertia, the mass of the first set of articles 44), at least in part by sensing, estimating, or calculating the torque ($\tau_{up}$) that the electric motor 48 outputs while causing the rotational speed of the first washing compartment 40 with the first set of articles 44 to increase from the second substantially constant rotational speed ($\omega_2$) to the first substantially constant rotational speed ($\omega_1$) over the second period of time ($\Delta_{t2}$). In other words, the controller 64 senses, estimates, or calculates the torque ($\tau_{down}$) that the electric motor 48 outputs during the deceleration stage and the torque ($\tau_{up}$) that the electric motor 48 outputs during the acceleration phase. The torques ($\tau_{down}$ and $\tau_{up}$) that the controller 64 sense, estimate, or calculate can be the average torques during the deceleration stage and the acceleration stage, respectively.

For example, the motor torque sensor 72*a* (e.g., the controller 64 that is part of the electric motor 48), or other suitable sensor, may sense and output the relevant data to the controller 64 to allow the controller 64 to obtain, estimate, or calculate the torque data ($\tau_{down}$ and $\tau_{up}$) and acceleration data ($\alpha_{down}$ and $\alpha_{up}$) of the first washing compartment 40 during the deceleration stage and the acceleration phase for use in determining the moment of inertia of the first washing compartment 40 (with the first set of articles 44). While the electric motor 48 decelerates and accelerates the first washing compartment 40 (with the first set of articles 44) according to commands from the controller 64, the actual deceleration and acceleration realized by the first washing compartment 40 will likely differ from the commanded acceleration and deceleration. As mentioned above, contemporary electric motors 48 often include their own controller that outputs data for such information. The electric motor 48, for example, can provide torque data, which the electric motor 48 calculates as a function of electrical current and bus voltage. The electric motor 48 then outputs that data to the controller 64. For some electric motors 48, this data is not available directly from the electric motor 48. When the data is not available, other values indicative of the torque may be used. For example, the torque may be proportional to a motor characteristic, such as the current of the electric motor 48, for example, which may be used instead and as part of an estimation of the moment of inertia.

In embodiments, the controller 64 estimates or calculates the moment of inertia of the first set of articles 44 (and, from the moment of inertia, the mass of the first set of articles 44), at least in part by estimating or calculating the moment of inertia of the first washing compartment 40 with the first set of articles 44 via an equation that divides ($\tau_{up}-\tau_{down}$) by ($\alpha_{up}-\alpha_{down}$). An example of such an equation is derived below. Generally, the torque that the electric motor 48 must output and impart to the first washing compartment 40 to rotate the first washing compartment 40 (with the first set of articles 44) can be represented by equation (1) below:

$$\tau=(J_{fwc+fsa}*\alpha)+(B*\omega)+C \quad (1)$$

where $\tau$ is torque, $J_{fwc+fsa}$ is inertia of the combined first washing compartment 40 ("fwc") and the first set of articles 44 ("fsa"), $\alpha$ is acceleration, B is a viscous damping (friction) coefficient unique to the washing machine 10, $\omega$ is the rotational speed of the first washing compartment 40, and C is the coulomb friction unique to the electric motor 48 and the washing machine 10 generally. It follows that the torque during the deceleration phase ($\tau_{down}$) and the acceleration phase ($\tau_{up}$) are, respectively:

$$\tau_{down}=(J_{fwc+fsa}*\alpha_{down})+(B*\omega_{down})+C \quad (2)$$

$$\tau_{up}=(J_{fwc+fsa}*\alpha_{up})+(B*\omega_{up})+C \quad (3)$$

The torque during the acceleration phase ($\tau_{up}$) is greater than the torque during the deceleration phase ($\tau_{down}$), and the difference between the torques is represented in equation (4) below:

$$\tau_{up}-\tau_{down}=((J_{fwc+fsa}*\alpha_{up})+(B*\omega_{up})+C)-((J_{fwc+fsa}*\alpha_{down})+(B*\omega_{down})+C \quad (4)$$

The coulomb friction C is the same for both the deceleration phase and the acceleration phase and thus cancel out. If the $\omega_{down}$ and the $\omega_{up}$ are considered as average rotational speeds of the first washing compartment 40 during the deceleration phase and the acceleration phase, respectively, and are equal, then the (B * $\omega_{down}$)+C and the (B * $\omega_{up}$)+C portions of equation (4) are equal and cancel out. With the friction related aspects canceling out, the result is equation (5) below:

$$\tau_{up}-\tau_{down}=J_{fwc+fsa}*(\alpha_{up}-\alpha_{down}) \quad (5)$$

Note that in instances where the electric motor 48 does not output torque data directly to the controller 64, the controller 64 can derive the torque during the acceleration phase ($\tau_{up}$) and the torque during the deceleration phase ($\tau_{down}$) from sensor-less torque estimation techniques using motor current readings, or the average current of electricity that the electric motor 48 utilizes during the acceleration phase ($I_{up}$) and the average current of electricity that the electric motor 48 utilizes during the deceleration phase ($I_{down}$), respectively, because the torque that the electric motor 48 is delivering is proportional to the motor current. In any event, solving for the moment of inertia $J_{fwc+fsa}$ of the first washing compartment 40 (with the first set of articles 44) thus provides equation (6) below:

$$J_{fwc+fsa}=\frac{(\tau_{up}-\tau_{down})}{(\alpha_{up}-\alpha_{down})} \quad (6)$$

The controller 64 can save this value in the memory 68 for subsequent use. The moment of inertia of the first washing compartment 40 ($J_{fwc}$) is known, constant, and stored in memory 68. Thus, the moment of inertia of the first set of articles 44 ($J_{fsa}$) can be determined with equation (7) below:

$$J_{fsa}=J_{fwc+fsa}-J_{fwc} \quad (7)$$

In other embodiments, instead of canceling out the viscous damping B and the coulomb friction C, an algorithm such as a recursive least squares algorithm, can estimate the values. The mass of the first set of articles 44 ($mass_{fsa}$) can be approximated from the inertia $J_{fsa}$ with equation (8) below:

$$mass_{fsa}=\frac{J_{fsa}}{r^2} \quad (8)$$

where r is an assumed radius of the first set of articles 56 inside the first washing compartment 40 relative to the axis 52. In some circumstances, the mass of the first set of articles 44 as estimated or calculated using the model detailed above will differ from the actual mass of the first set of articles 44, because of modeling imprecision and "noise". Thus, the relationship between the mass of the first set of articles 44 estimated/calculated from the equation (8) and the model above and the true mass of the first set of articles 44 can be experimentally correlated, such that the model includes the controller 64 executing equation (9) below:

$$mass_{fsa_actual}=f(J_{fsa})+N \quad (9)$$

where $mass_{fsa_actual}$ is the true mass of the first set of articles 44, or at least a closer approximation thereof and N are the experimentally deduced noise factors, which, in embodiments, varies as a function of the model of the washing machine 10. The noise factors (N) can be predicted using statistical modeling where it is experimentally or empirically tuned for a specific class or platform of products. The controller 64 can then cause the determined mass of the first set of articles 44 ($mass_{fsa_actual}$) to be stored in the memory 68.

The method 72 further includes, at step 76, estimating or calculating a mass of the second set of articles 56 in (i.e., held by) the second washing compartment 54. This step 76 will occur after the second washing compartment 54 is placed into the inserted position 58 and the second set of articles 56 is loaded into the second washing compartment 54. The controller 64 can prompt the user at the user interface 34 to place the second washing compartment 54 in the inserted position 58, and to load the second set of articles 56 into the second washing compartment 54. In embodiments, this step 76 occurs after step 74 but need not. The controller 64 can confirm that the lid 26 is in the closed position 30 before estimating or calculating the mass of the second set of articles 56 in the second washing compartment 54.

At this point, in this embodiment, the washing machine 10 includes the first washing compartment 40 (holding the first set of articles 44) and the second washing compartment 54 (holding the second set of articles 56) in the inserted position 58. At step 74, the controller 64 already estimated or calculated the mass of the first set of articles 44 when the second washing compartment 54 was in the removed position 59 and stored that value in the memory 68. Thus, in embodiments, to estimate or calculate the mass of the second set of articles 56, the controller 64: (i) estimates or calculates the collective mass of the first set of articles 44 and the second set of articles 56 when the second washing compartment 54 is in the inserted position 58; and then (ii) subtracts the estimated or calculated mass of the first set of articles 44 stored in the memory 68 from the estimated or calculated collective mass of the first set of articles 44 and the second set of articles 56.

In embodiments, to estimate or calculate the collective mass of the first set of articles 44 and the second set of articles 56 when the second washing compartment 54 is in the inserted position 58, the controller 64 again performs the mathematics model detailed above to determine the moment of inertia of the first set of articles 44 and the second set of articles 56 combined. In embodiments, the controller 64 estimates or calculates the moment of inertia of the first set of articles 44 and the second set of articles 56 combined (and, from the moment of inertia, the mass of the first set of articles 44 and the mass of the second set of articles 56 combined), at least in part by causing the first washing compartment 40 (holding the first set of articles 44) and the second washing compartment 54 (holding the second set of articles 56) to rotate according to a rotational speed as a function of time profile as set forth in FIG. 9. First, the controller 64 causes the electric motor 48 to rotate the first washing compartment 40 and the second washing compartment 54 (holding the first set of articles 44 and the second set of articles 56, respectively) at a first substantially constant rotational speed ($\omega_1$), after a ramp up period where the first washing compartment 40 and the second washing compartment 54 are accelerated from a rest state to the first substantially constant rotational speed ($\omega_1$). Second, during a deceleration stage, the controller 64 controls the electric motor 48 to cause the rotational speed of the first washing compartment 40 (containing the first set of articles 44) and the second washing compartment 54 (containing the second set of articles 56) to decrease from the first substantially constant rotational speed ($\omega_1$) to a second substantially constant rotational speed ($\omega_2$) over a first period of time ($\Delta_{t1}$) for an average deceleration ($\alpha_{down}$) of $(\omega_1-\omega_2)/\Delta_{t1}$. Third, during an acceleration phase, the controller 64 controls the electric motor 48 to cause the rotational speed of the first washing compartment 40 (containing the first set of articles 44) and the second washing compartment 54 (containing the second set of articles 56) to increase to the first substantially constant rotational speed ($\omega_1$) over a second period of time ($\Delta_{t2}$) for an average acceleration ($\alpha_{up}$) of $(\omega_2-\omega_1)/\Delta_{t2}$. In embodiments, the controller 48 then controls the electric motor 48 to maintain the first substantially constant rotational speed ($\omega_1$) (see path B, FIG. 9) until the controller 48 initiate a subsequent sensing iteration or some other step of the washing operation.

In embodiments, the controller 64 estimates or calculates the collective moment of inertia of the first set of articles 44 and the second set of articles 56 (and, from the moment of inertia, the combined mass of the first set of articles 44 and the second set of articles 56) when the second washing compartment 54 is in the inserted position 58 and the second set of articles 56 is disposed in the second washing compartment 54 at least in part by calculating the torque ($\tau_{down}$) that the electric motor 48 outputs while causing the rotational speed of the first washing compartment 40 with the first set of articles 44 and the second washing compartment 54 with the second set of articles 56 to decrease from the first substantially constant rotational speed ($\omega_1$) to the second substantially constant rotational speed ($\omega_2$) over the first period of time ($\Delta_{t1}$). Similarly, In embodiments, the controller 64 estimates or calculates the collective moment of inertia of the first set of articles 44 and the second set of articles 56 (and, from the moment of inertia, the combined mass of the first set of articles 44 and the second set of articles 56) when the second washing compartment 54 is in the inserted position 58 and the second set of articles 56 is disposed in the second washing compartment 54 at least in part by calculating the torque ($\tau_{up}$) that the electric motor 48 outputs while causing the rotational speed of the first washing compartment 40 with the first set of articles 44 and the second washing compartment 54 with the second set of articles 56 to increase from the second substantially constant rotational speed ($\omega_2$) to the first substantially constant rotational speed ($\omega_1$) over the second period of time ($\Delta_{t2}$). In other words, the controller 64 senses, estimates, or calculates the torque ($\tau_{down}$) that the electric motor 48 outputs during the deceleration stage and the torque ($\tau_{up}$) that the electric motor 48 outputs during the acceleration phase. The torques ($\tau_{down}$) and $\tau_{up}$) that the controller 64 sense, estimate, or calculate can be the average torques during the deceleration stage and the acceleration stage, respectively. Note that in instances where the electric motor 48 does not output torque data directly to the controller 64, the controller 64 can derive the torques during the acceleration phase ($\tau_{up}$) and the torque during the deceleration phase ($\tau_{down}$) from the average current of electricity that the electric motor 48 utilizes during the acceleration phase ($I_{up}$) and the average current of electricity that the electric motor 48 utilizes during the deceleration phase ($I_{down}$), respectively, because the torque that the electric motor 48 is delivering is proportional to the current.

In embodiments, the controller 64 estimates or calculates the moment of inertia of the first set of articles 44 and the second set of articles 56 collectively (and, from the moment of inertia, the collective mass of the first set of articles 44 and the second set of articles 56), at least in part by estimating or calculating the moment of inertia of the first washing compartment 40 with the first set of articles 44 and the second washing compartment 54 with the second set of articles 56 via an equation that divides ($\tau_{up}-\tau_{down}$) by ($\alpha_{up}-\alpha_{down}$). An example of such an equation was derived above and the same principles apply now. However, note that the equation (10), reproduced below, will be the moment of inertia $J_{total}$ of the first washing compartment 40 (with the first set of articles 44) and the second washing compartment 54 (with the second set of articles 56) collectively:

$$J_{total} = \frac{(\tau_{up} - \tau_{down})}{(\alpha_{up} - \alpha_{down})} \tag{10}$$

Using equation 11 below, the moment of inertia ($J_{swc+ssa}$) of only the second washing compartment 54 ("swc") and the second set of articles 56 ("ssa") can be determined:

$$J_{swc+ssa}=J_{total}-J_{fwc+fsa} \tag{11}$$

The moment of inertia ($J_{fwc+fsa}$) for the first washing compartment 40 (with the first set of articles 44) is stored in the memory 68, as detailed above. Thus the moment of inertia of only the second washing compartment 54 (with the second set of articles 56), $J_{swc+ssa}$, can be determined. In addition, the moment of inertia for the second washing compartment 54 ($J_{swc}$) is known, constant, and stored in memory 58. Accordingly, the moment of inertia for the second set of articles 56 ("ssa") can be determined from equation (12) below:

$$J_{ssa}=J_{swc+ssa}-J_{swc} \tag{12}$$

The mass ($mass_{ssa}$) of the second set of articles 56 can be approximated from the inertia of the second set of articles 56 ($J_{ssa}$) with equation (13) below:

$$mass_{ssa} = \frac{J_{ssa}}{r^2} \tag{13}$$

where r is an assumed radius of the second set of articles 56 inside the second washing compartment 54 relative to the axis 52. In other words, estimating or calculating the mass of the second set of articles 56 ($mass_{ssa}$) in the second washing compartment 54 includes, at least in part, estimating or calculating: (a) the moment of inertia ($J_{fwc+fsa}$) of the first washing compartment 40 and the first set of articles 44 when the second washing compartment 54 is in the removed position 59; (b) the collective moment of inertia ($J_{total}$) of the first washing compartment 40, the first set of articles 44, the second washing compartment 54, and the second set of articles 56 when the second washing compartment is in the inserted position 58; and (c) subtracting (a) from (b) as in equation (12). Again, in some circumstances, the mass of the second set of articles 56 as estimated or calculated using the model detailed above will differ from the actual mass of the second set of articles 56, because of modeling imprecision (such as that surrounding equation (13)) and "noise". Thus, the relationship between the mass of the second set of articles 56 estimated/calculated from the equation (13) and the model above and the true mass of the second set of articles 56 can be experimentally correlated, such that the model includes the controller 64 executing equation (14) below:

$$\text{mass}_{ssa_actual}=f(J_{ssa})+N \quad (14)$$

where $\text{mass}_{ssa_actual}$ is the true mass of the second set of articles 56, or at least a better closer approximation thereof and N are the experimentally deduced noise factors, which will likely depend on the washing machine 10. The noise factors (N) can be predicted using statistical modeling where it is experimentally or empirically tuned for a specific class or platform of products. The controller 64 can then cause the determined mass of the second set of articles 56 ($\text{mass}_{ssa_actual}$) to be stored in the memory 68.

The method 72 further includes, at step 78, adding a second volume of water to the second washing compartment 54, without causing water added to the second washing compartment 54 to overflow from the second washing compartment 54 into the first washing compartment 40. The second volume of water is determined as a function of the estimated or calculated mass of the second set of articles 56. In embodiments, the second volume of water ($V_{second}$) is determined according to equation (15) below:

$$V_{second}=f(\text{mass}_{sac_model}) \quad (15)$$

The second volume of water ($V_{second}$) can be experimentally correlated with the mass of the second set of articles 56 ($\text{mass}_{sac_model}$), and, in some instances, will depend on the geometry of the second washing compartment 54. In embodiments, the second volume of water is proportional to the mass of the second set of articles 56, will be of sufficient volume to allow for the laundering of the second set of articles 56, but will not overflow into the first washing compartment 40.

The method 72 further includes, at step 80, adding a first volume of water to the first washing compartment 40. Note that this step can occur simultaneously with or before step 78. The first volume of water is determined as a function of the estimated or calculated mass of the first set of articles 44. In embodiments, the first volume of water ($V_{first}$) is determined according to equation (16) below:

$$V_{first}=f(\text{mass}_{fsa_actual}) \quad (16)$$

The first volume of water ($V_{first}$) can be experimentally correlated with the mass ($\text{mass}_{fsa_actual}$) of the first set of articles 44, and, in embodiments, depend on the geometry of the first washing compartment 40. In embodiments, the first volume of water is proportional to the mass of the first set of articles 44 and will be of sufficient volume to allow for laundering of the first set of articles 44, but not an excessive volume.

In a variation of the method 72, after step 74, instead of proceeding to step 76, the method 72 proceeds to step 82. At step 82, the method 72 further includes the first washing compartment 40 and the second washing compartment 54 to rotate together at a predetermined rotational speed ($\omega_{pre}$). The second washing compartment 54 is in the inserted position 58 after step 74 and contains the second set of articles 56, and, as described in connection with step 73, the first washing compartment 50 includes the first set of articles 44. The controller 64 can cause the electric motor 48 to rotate the first washing compartment 40 and the second washing compartment 54 at the predetermined rotational speed ($\omega_{pre}$).

Next, at step 84, liquid from the external liquid source 62 flows from the external liquid source 62 and into the second washing compartment 54 while the first washing compartment 40 and the second washing compartment 54 are rotating at the predetermined rotational speed. The liquid can be water. The controller 64 can cause the liquid flow valve 60 to cause the liquid to flow into the second washing compartment 54.

Next, at step 86, the electric motor 48 is caused (such as via the controller 64 controlling the electric motor 48) to maintain rotating the first washing compartment 40 and the second washing compartment 54 at the predetermined rotational speed ($\omega_{pre}$) as liquid flows into the second washing compartment 54, while monitoring the moment of inertia of the second washing compartment 54 together with the second set of articles 56 and the liquid in the second washing compartment 54. The moment of inertia of the first washing compartment 40 with the first set of articles 44 was determined in step 74 and, thus, the moment of inertia of the second washing compartment 54 together with the second set of articles 56 and the liquid in the second washing compartment 54 can be repeatedly calculated and monitored. In embodiments, the controller 64 can monitor the moment of inertia of the second washing compartment 54 together with the second set of articles 56 and the liquid in the second washing compartment 54 as detailed above in the lead up to and including equation (11). The only difference is that the moment of inertia is a product of the mass of the liquid added to the second washing compartment 54, in addition to the second set of articles 56 and the second washing compartment 54 itself. However, the controller 64 can repeatedly determine the moment of inertia in any suitable manner. In embodiments, the controller 64 determines a rate of change of the repeatedly determined moment of inertia. Moments of inertia may be determined in a variety of ways and additional description of methods for determining inertia may be found in U.S. Pat. No. 9,540,756; United States Patent Application Publication No. US20150047396A1; and U.S. Pat. No. 9,091,011, which are incorporated herein by reference in their entireties.

Next, at step 88, as the moment of inertia meets or exceeds a predetermined value, or the rate of change of the moment of inertia satisfies a predetermined threshold, the electric motor 48 (such as from a command from the controller 64) stops rotating the first washing compartment 40 and the second washing compartment 54 and to stop liquid from flowing from the liquid supply system into the second washing compartment 54. In embodiments, these threshold values are stored in the memory 68 of the controller 64. The predetermined value of the moment of inertia represents a combined mass of the second set of articles 56 and the volume of liquid added to the second washing compartment 54 that has a sufficient volume of liquid to wash the second set of articles 56 but insufficient volume of liquid to cause the liquid to overflow into the first washing compartment 40. The method 72 then proceeds to step 80, where a volume of liquid is added to the first washing compartment 40 as a function of the determined mass of the first set of articles 44.

After the method 72 is complete, the washing machine 10 then completes a wash cycle and any other desired functions to launder the first set of articles 44 and the second set of articles 56.

According to one aspect of the present disclosure, a washing machine includes a tub. A first washing compartment is disposed within the tub to hold a first set of articles to be washed, the first set of articles having a mass. A second washing compartment holds a second set of articles to be washed, the second set of articles having a mass, the second washing compartment having an inserted position and a removed position. A liquid flow valve is configured to connect to an external liquid source to selectively control flow of liquid from the external liquid source and into either the first washing compartment, the second washing compartment, or both the first washing compartment and the second washing compartment. An electric motor is operably coupled to and configured to cause the first washing compartment to rotate, and operably coupled to and configured to cause the second washing compartment to rotate when the second washing compartment is in the inserted position but not in the removed position. A controller is in communication with the electric motor that estimates or calculates the mass of the second set of articles held by the second washing compartment and then calculates, as a function of the estimated or calculated mass of the second set of articles, a volume of water to be added to the second washing compartment.

According to another aspect of the present disclosure, the controller estimates or calculates the mass of the second set of articles ($mass_{ssa}$) at least in part by: (i) estimating or calculating a moment of inertia ($J_{fwc+fsa}$) of the first washing compartment and the first set of articles when the second washing compartment is in the removed position; and (ii) estimating or calculating the collective moment of inertia ($J_{total}$) of the first washing compartment, the first set of articles, the second washing compartment, and the second set of articles when the second washing compartment is in the inserted position; and then (iii) subtracting (i) from (ii).

According to another aspect of the present disclosure, the electric motor includes a shaft that rotates about an axis and that is operably connected to the first washing compartment such that as the electric motor causes the shaft to rotate about the axis, the first washing compartment also rotates about the axis; and the controller estimates or calculates the mass of the first set of articles when the second washing compartment is in the removed position at least in part by: (i) causing the first washing compartment with the first set of articles to rotate at a first substantially constant rotational speed ($\omega_1$); (ii) causing the rotational speed of the first washing compartment with the first set of articles to decrease to a second substantially constant rotational speed ($\omega_2$) over a first period of time ($\Delta_{t1}$) for an average deceleration ($\alpha_{down}$) of $(\omega_1-\omega_2)/\Delta_{t1}$; and (iii) causing the rotational speed of the first washing compartment with the first set of articles to increase from the second substantially constant rotational speed ($\omega_2$) to the first substantially constant rotational speed ($\omega_1$) over a second period of time ($\Delta_{t2}$) for an average acceleration ($\alpha_{up}$) of $(\alpha_{up})/\Delta_{t2}$.

According to another aspect of the present disclosure, the controller estimates or calculates the mass of the first set of articles when the second washing compartment is in the removed position at least in part by sensing, estimating, or calculating a torque ($\tau_{down}$) that the electric motor outputs while causing the rotational speed of the first washing compartment with the first set of articles to decrease from the first substantially constant rotational speed ($\omega_1$) to the second substantially constant rotational speed ($\omega_2$) over the first period of time ($\Delta_{t1}$).

According to another aspect of the present disclosure, the controller estimates or calculates the mass of the first set of articles when the second washing compartment is in the removed position at least in part by sensing, estimating, or calculating a torque ($\tau_{up}$) that the electric motor outputs while causing the rotational speed of the first washing compartment with the first set of articles to increase from the second substantially constant rotational speed ($\omega_2$) to the first substantially constant rotational speed ($\omega_1$) over the second period of time ($\Delta_{t2}$).

According to another aspect of the present disclosure, the controller estimates or calculates the mass of the first set of articles when the second washing compartment is in the removed position at least in part by estimating or calculating a moment of inertia of the first washing compartment with the first set of articles via an equation that divides ($\tau_{up}-\tau_{down}$) by ($\alpha_{up}-\alpha_{down}$).

According to another aspect of the present disclosure, the controller derives the torque during an acceleration phase ($\tau_{up}$) and the torque during a deceleration phase ($\tau_{down}$) from an average current of electricity that the electric motor utilizes during the acceleration phase ($I_{up}$) and the average current of electricity that the electric motor utilizes during the deceleration phase ($I_{down}$), respectively.

According to another aspect of the present disclosure, the electric motor is additionally operably connected to the second washing compartment such that as the electric motor causes the shaft to rotate about the axis, both the first washing compartment and the second washing compartment also rotate about the axis; and the controller estimates or calculates the collective mass of the first set of articles and the second set of articles when the second washing compartment is in the inserted position and the second set of articles is disposed in the second washing compartment at least in part by: (i) causing the first washing compartment with the first set of articles and the second washing compartment with the second set of articles to rotate at a first substantially constant rotational speed ($\omega_1$); (ii) causing the rotational speed of the first washing compartment with the first set of articles and the second washing compartment with the second set of articles to decrease to a second substantially constant rotational speed ($\omega_2$) over a first period of time ($\Delta_{t1}$) for an average deceleration ($\alpha_{down}$) of $(\omega_1-\omega_2)/\Delta_{t1}$; and (iii) causing the rotational speed of the first washing compartment with the first set of articles and the second washing compartment with the second set of articles to increase to the first substantially constant rotational speed ($\omega_1$) over a second period of time ($\Delta_{t2}$) for an average acceleration ($\alpha_{up}$) of $(\omega_2-\omega_1)/\Delta_{t2}$.

According to another aspect of the present disclosure, the controller estimates or calculates the collective mass of the first set of articles and the second set of articles when the second washing compartment is in the inserted position and the second set of articles is disposed in the second washing compartment at least in part by calculating a torque ($\tau_{down}$) that the electric motor outputs while causing the rotational speed of the first washing compartment with the first set of articles and the second washing compartment with the second set of articles to decrease from the first substantially constant rotational speed ($\omega_1$) to the second substantially constant rotational speed ($\omega_2$) over the first period of time ($\Delta_{t1}$).

According to another aspect of the present disclosure, the controller estimates or calculates the collective mass of the first set of articles and the second set of articles when the second washing compartment is in the inserted position and the second set of articles is disposed in the second washing compartment at least in part by calculating a torque ($\tau_{up}$) that the electric motor outputs while causing the rotational speed of the first washing compartment with the first set of articles and the second washing compartment with the second set of articles to increase from the second substantially constant rotational speed ($\omega_2$) to the first substantially constant rotational speed ($\omega_1$) over the second period of time ($\Delta_{t2}$).

According to another aspect of the present disclosure, the controller estimates or calculates the collective mass of the first set of articles and the second set of articles when the second washing compartment is in the inserted position and the second set of articles is disposed in the second washing compartment at least in part by estimating or calculating a moment of inertia of the first washing compartment with the first set of articles and the second washing compartment with the second set of articles via an equation that divides ($\tau_{up}-\tau_{down}$) by ($\alpha_{up}-\alpha_{down}$).

According to another aspect of the present disclosure, the controller derives the torque during the acceleration phase ($\tau_{up}$) and the torque during the deceleration phase ($\tau_{down}$) from the average current of electricity that the electric motor utilizes during the acceleration phase ($I_{up}$) and the average current of electricity that the electric motor utilizes during the deceleration phase ($I_{down}$), respectively.

According to yet another aspect of the present disclosure, a washing machine includes a tub. A first washing compartment is disposed within the tub to hold a first set of articles to be washed, the first set of articles having a mass. A second washing compartment holds a second set of articles to be washed, the second set of articles having a mass, the second washing compartment having an inserted position and a removed position. A liquid flow valve is configured to connect to an external liquid source to selectively control flow of liquid from the external liquid source and into either the first washing compartment, the second washing compartment, or both the first washing compartment and the second washing compartment. An electric motor is operably coupled to and configured to cause the first washing compartment to rotate, and operably coupled to and configured to cause both the first washing compartment and the second washing compartment to rotate when the second washing compartment is in the inserted position but not in the removed position. A controller is in communication with the electric motor and is configured to: (a) to cause the electric motor to rotate together the first washing compartment and the second washing compartment at a predetermined rotational speed when the second washing compartment is in the inserted position and contains the second set of articles; (b) to cause liquid to flow from the external liquid source and into the second washing compartment while the second washing compartment is rotating at the predetermined rotational speed; (c) to cause the electric motor to maintain rotating the first washing compartment and the second washing compartment at the predetermined rotational speed, while the monitoring the moment of inertia of the second washing compartment together with the second set of articles and the liquid in the second washing compartment; and (d) as the moment of inertia meets or exceeds a predetermined value, or as the moment of inertia meets or exceeds a predetermined rate of change, to cause the electric motor to stop rotating the first washing compartment and the second washing compartment and to stop liquid from flowing from a liquid supply system into the second washing compartment.

According to yet another aspect of the present disclosure, the controller is further configured to estimate or calculate the mass of the first set of articles in the first washing compartment, when the second washing compartment is in the removed position.

According to yet another aspect of the present disclosure, the controller is configured to estimate or calculate the mass of the first set of articles in the first washing compartment by manipulating the electric motor: (i) to cause the first washing compartment with the first set of articles to rotate at a first substantially constant rotational speed ($\omega_1$); (ii) to cause the rotational speed of the first washing compartment with the first set of articles to decrease to a second substantially constant rotational speed ($\omega_2$) over a first period of time ($\Delta_{t1}$) for an average deceleration ($\alpha_{down}$) of $(\omega_1-\omega_2)/\Delta_{t1}$; and (iii) to cause the rotational speed of the first washing compartment with the first set of articles to increase to the first substantially constant rotational speed ($\omega_1$) over a second period of time ($\Delta_{t2}$) for an average acceleration ($\alpha_{up}$) of $(\omega_2-\omega_1)/\Delta_{t2}$.

According to yet another aspect of the present disclosure, the controller is configured: (d) as the moment of inertia meets or exceeds a predetermined rate of change, to cause the electric motor to stop rotating the first washing compartment and the second washing compartment and to stop liquid from flowing from a liquid supply system into the second washing compartment.

According to still yet another aspect of the present disclosure, a method of adding a volume of water to a removable washing compartment of a washing machine includes after a first set of articles is loaded into a first washing compartment of a washing machine and while a second washing compartment of the washing machine is in a removed position, estimating or calculating a mass of the first set of articles in the first washing compartment; after the second washing compartment is placed into an inserted position and a second set of articles is loaded into the second washing compartment, estimating or calculating a mass of the second set of articles in the second washing compartment; adding a second volume of water to the second washing compartment, without causing water added to the second washing compartment to overflow from the second washing compartment into the first washing compartment, the second volume of water determined as a function of the estimated or calculated mass of the second set of articles; and adding a first volume of water to the first washing compartment, the first volume of water determined as a function of the estimated or calculated mass of the first set of articles.

According to still yet another aspect of the present disclosure, estimating or calculating a mass of the first set of articles in the first washing compartment includes causing an electric motor of the washing machine to rotate the first washing compartment about an axis and evaluating one or more of: (i) torque that the electric motor outputs while rotating the first washing compartment; (ii) rotational acceleration and/or deceleration of the first washing compartment; (iii) the moment of inertia of the first washing compartment while the electric motor rotates the first washing compartment; and (iv) the electrical current that the electric motor is utilizing while the electric motor rotates the first washing compartment.

According to still yet another aspect of the present disclosure, estimating or calculating a mass of the second set of articles in the second washing compartment includes causing the electric motor of the washing machine to rotate the first washing compartment together with the second washing compartment about an axis and evaluating one or more of: (i) torque that the electric motor outputs while rotating the first washing compartment together with the second washing compartment; (ii) rotational acceleration and/or deceleration of the first washing compartment together with the second washing compartment; (iii) moment(s) of inertia of the first washing compartment together with the second washing compartment while the electric motor rotates the first washing compartment together with the second washing compartment; and (iv) electrical current that the electric motor is utilizing while the electric motor rotates the first washing compartment together with the second washing compartment.

According to still yet another aspect of the present disclosure, estimating or calculating a mass of the second set of articles in the second washing compartment includes determining: (a) the moment of inertia of the first washing compartment and the first set of articles; (b) the moment of inertia of the first washing compartment, the first set of articles, the second washing compartment, and the second set of articles together; and (c) subtracting (a) from (b).

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A washing machine comprising:

a tub;

a first washing compartment disposed within the tub to hold a first set of articles to be washed, the first set of articles having a mass;

a second washing compartment to hold a second set of articles to be washed, the second set of articles having a mass, the second washing compartment having an inserted position and a removed position;

a liquid flow valve configured to connect to an external liquid source to selectively control flow of water from the external liquid source and into either the first washing compartment, the second washing compartment, or both the first washing compartment and the second washing compartment;

an electric motor operably coupled to and configured to cause the first washing compartment to rotate, and operably coupled to and configured to cause the second washing compartment to rotate when the second washing compartment is in the inserted position but not in the removed position; and a controller in communication with the electric motor that is configured to (i) estimate or calculate the mass of the first set of articles held by the first washing compartment when the second washing compartment is in the removed position; (ii) estimate or calculate the mass of the second set of articles held by the second washing compartment when the second washing compartment is in the inserted position; and (iii) then calculates, as a function of the estimated or calculated mass of the second set of articles, a volume of water to be added to the second washing compartment.

2. The washing machine of claim 1, the controller is configured to estimate or calculate the mass of the second set of articles ($mass_{ssa}$) at least in part by: (i) estimating or calculating a moment of inertia ($J_{fwc+fsa}$) of the first washing compartment and the first set of articles when the second washing compartment is in the removed position; and (ii) estimating or calculating a collective moment of inertia ($J_{total}$) of the first washing compartment, the first set of articles, the second washing compartment, and the second set of articles when the second washing compartment is in the inserted position; and then (iii) subtracting (i) from (ii).

3. The washing machine of claim 2, the electric motor includes a shaft that rotates about an axis and that is operably connected to the first washing compartment such that as the electric motor causes the shaft to rotate about the axis, the first washing compartment also rotates about the axis; and the controller is configured to estimate or calculate the mass of the first set of articles when the second washing compartment is in the removed position at least in part by: (i) causing the first washing compartment with the first set of articles to rotate at a first substantially constant rotational speed ($\omega_1$); (ii) causing the first washing compartment with the first set of articles to decrease from the first substantially constant rotational speed ($\omega_1$) to a second substantially constant rotational speed ($\omega_2$) over a first period of time ($\Delta_{t1}$) for an average deceleration ($\alpha_{down}$) of $(\omega_1-\omega_2)/\Delta_{t1}$; and (iii) causing the first washing compartment with the first set of articles to increase from the second substantially constant rotational speed ($\omega_2$) to the first substantially constant rotational speed ($\omega_1$) over a second period of time ($\Delta_{t2}$) for an average acceleration ($\alpha_{up}$) of ($\alpha_{up}$)/$\Delta_{t2}$.

4. The washing machine of claim 3, the controller is configured to estimate or calculate the mass of the first set of articles when the second washing compartment is in the removed position at least in part by sensing, estimating, or calculating a torque ($\tau_{down}$) that the electric motor outputs while causing the first washing compartment with the first set of articles to decrease from the first substantially constant rotational speed ($\omega_1$) to the second substantially constant rotational speed ($\omega_2$) over the first period of time ($\Delta_{t1}$).

5. The washing machine of claim 4, the controller is configured to estimate or calculate the mass of the first set of articles when the second washing compartment is in the removed position at least in part by sensing, estimating, or calculating a torque ($\tau_{up}$) that the electric motor outputs while causing the first washing compartment with the first set of articles to increase from the second substantially constant rotational speed ($\omega_2$) to the first substantially constant rotational speed ($\omega_1$) over the second period of time ($\Delta_{t2}$).

6. The washing machine of claim 5, the controller is configured to estimate or calculate the mass of the first set of articles when the second washing compartment is in the removed position at least in part by estimating or calculating the moment of inertia ($J_{fwc+fsa}$) of the first washing compartment and the first set of articles via an equation that divides ($\tau_{up}-\tau_{down}$) by ($\alpha_{up}-\alpha_{down}$).

7. The washing machine of claim 5, the controller is configured to derive the torque during an acceleration phase ($\tau_{up}$) and the torque during a deceleration phase ($\tau_{down}$) from an average current of electricity that the electric motor utilizes during the acceleration phase ($I_{up}$) and an average current of electricity that the electric motor utilizes during the deceleration phase ($I_{down}$), respectively.

8. The washing machine of claim 3, the electric motor is additionally operably connected to the second washing compartment such that as the electric motor causes the shaft to rotate about the axis, both the first washing compartment and the second washing compartment also rotate about the axis; and the controller is configured to estimate or calculate the collective moment of inertia ($J_{total}$) at least in part by: (i) causing the first washing compartment with the first set of articles and the second washing compartment with the second set of articles to rotate at a first substantially constant rotational speed ($\omega_1$); (ii) causing the first washing compartment with the first set of articles and the second washing compartment with the second set of articles to decrease from the first substantially constant rotational speed ($\omega_1$) to a second substantially constant rotational speed ($\omega_2$) over a first period of time ($\Delta_{t1}$) for an average deceleration ($\alpha_{down}$) of ($\omega_1-\omega_2$)/$\Delta_{t1}$; and (iii) causing the first washing compartment with the first set of articles and the second washing compartment with the second set of articles to increase from the second substantially constant rotational speed ($\omega_2$) to the first substantially constant rotational speed ($\omega_1$) over a second period of time ($\Delta_{t2}$) for an average acceleration ($\alpha_{up}$) of ($\omega_2-\omega_1$)/$\Delta_{t2}$.

9. The washing machine of claim 8, the controller is configured to estimate or calculate the collective moment of inertia ($J_{total}$) at least in part by calculating a torque ($\tau_{down}$) that the electric motor outputs while causing the first washing compartment with the first set of articles and the second washing compartment with the second set of articles to decrease from the first substantially constant rotational speed ($\omega_1$) to the second substantially constant rotational speed ($\omega_2$) over the first period of time ($\Delta_{t1}$).

10. The washing machine of claim 9, the controller is configured to estimate or calculate the collective moment of inertia ($J_{total}$) at least in part by calculating a torque ($\tau_{up}$) that the electric motor outputs while causing the rotational speed of the first washing compartment with the first set of articles and the second washing compartment with the second set of articles to increase from the second substantially constant rotational speed ($\omega_2$) to the first substantially constant rotational speed ($\omega_1$) over the second period of time ($\Delta_{t2}$).

11. The washing machine of claim 10, the controller is configured to estimate or calculate the collective moment of inertia ($J_{total}$) at least in part via an equation that divides ($\tau_{up}-\tau_{down}$) by ($\alpha_{up}-\alpha_{down}$).

12. The washing machine of claim 10, the controller is configured to derive the torque during the acceleration phase ($\tau_{up}$) and the torque during the deceleration phase ($\tau_{down}$) from an average current of electricity that the electric motor utilizes during the acceleration phase ($I_{up}$) and an average current of electricity that the electric motor utilizes during the deceleration phase ($I_{down}$), respectively.

13. The washing machine of claim 1, wherein the controller is configured to further cause the liquid flow valve to deposit the volume of water, as calculated, to the second washing compartment; and the volume of water, as calculated, is insufficient to overflow from the second washing compartment into the first washing compartment.

14. The washing machine of claim 1, wherein in the inserted position, the second washing compartment is inserted above, and partially surrounded by, the first washing compartment.

15. The washing machine of claim 1 further comprising:

a lid selectively movable between a closed position and an opened position, wherein, when the lid is in the closed position and the second washing compartment is in the inserted position, the second washing compartment is disposed below the lid.

16. The washing machine of claim 1, wherein the first set of articles and the second set of articles are simultaneously washed.

17. A washing machine comprising:

a tub;

a first washing compartment disposed within the tub to hold a first set of articles to be washed, the first set of articles having a mass;

a second washing compartment to hold a second set of articles to be washed, the second set of articles having a mass, the second washing compartment having an inserted position and a removed position;

a liquid flow valve configured to connect to an external liquid source to selectively control flow of liquid from the external liquid source and into either the first washing compartment, the second washing compartment, or both the first washing compartment and the second washing compartment;

an electric motor operably coupled to and configured to cause the first washing compartment to rotate, and operably coupled to and configured to cause both the first washing compartment and the second washing compartment to rotate when the second washing compartment is in the inserted position but not in the removed position; and a controller in communication with the electric motor configured: (a) to cause the electric motor to rotate together the first washing compartment and the second washing compartment at a predetermined rotational speed when the second washing compartment is in the inserted position and contains the second set of articles; (b) to cause liquid to flow from the external liquid source and into the second washing compartment while the second washing compartment is rotating at the predetermined rotational speed; (c) to cause the electric motor to maintain rotating the first washing compartment and the second washing compartment at the predetermined rotational speed, while monitoring the moment of inertia of the second washing compartment together with the second set of articles and the liquid in the second washing compartment; and (d) as the moment of inertia meets or exceeds a predetermined value, or as the moment of inertia meets or exceeds a predetermined rate of change, to cause the electric motor to stop rotating the first washing compartment and the second washing compartment and to stop liquid from flowing from a liquid supply system into the second washing compartment.

18. The washing machine of claim 17, the controller is further configured to estimate or calculate the mass of the first set of articles in the first washing compartment, when the second washing compartment is in the removed position.

19. The washing machine of claim 18, the controller is configured to estimate or calculate the mass of the first set of articles in the first washing compartment by manipulating the electric motor: (i) to cause the first washing compartment with the first set of articles to rotate at a first substantially constant rotational speed ($\omega_1$); (ii) to cause the first washing compartment with the first set of articles to decrease from the substantially constant rotational speed ($\omega_1$) to a second substantially constant rotational speed ($\omega_2$) over a first period of time ($\Delta_{t1}$) for an average deceleration ($\alpha_{down}$) of $(\omega_1-\omega_2)/\Delta_{t1}$; and (iii) to cause the first washing compartment with the first set of articles to increase from the second substantially constant rotational speed ($\omega_2$) to the first substantially constant rotational speed ($\omega_1$) over a second period of time ($\Delta_{t2}$) for an average acceleration ($\alpha_{up}$) of $(\omega_2-\omega_1)/\Delta_{t2}$.

20. The washing machine of claim 17, the controller is configured, as the moment of inertia meets or exceeds a predetermined rate of change, to cause the electric motor to stop rotating the first washing compartment and the second washing compartment and to stop liquid from flowing from the external liquid source into the second washing compartment.

* * * * *